US012044450B2

(12) United States Patent
Izadi-Zamanabadi et al.

(10) Patent No.: US 12,044,450 B2
(45) **Date of Patent: *Jul. 23, 2024**

(54) METHOD FOR TERMINATING DEFROSTING OF AN EVAPORATOR

(71) Applicant: Danfoss A/S, Nordborg (DK)

(72) Inventors: Roozbeh Izadi-Zamanabadi, Nordborg (DK); Carsten Mølhede Thomsen, Nordborg (DK)

(73) Assignee: DANFOSS A/S, Nordborg (DK)

( * ) Notice: Subject to any disclaimer, the term of this patent is extended or adjusted under 35 U.S.C. 154(b) by 865 days.

This patent is subject to a terminal disclaimer.

(21) Appl. No.: 17/044,170

(22) PCT Filed: Jun. 11, 2019

(86) PCT No.: PCT/EP2019/065120
§ 371 (c)(1),
(2) Date: Sep. 30, 2020

(87) PCT Pub. No.: WO2019/243106
PCT Pub. Date: Dec. 26, 2019

(65) Prior Publication Data

US 2021/0033325 A1 Feb. 4, 2021

(30) Foreign Application Priority Data

Jun. 22, 2018 (EP) ..... 18179424

(51) Int. Cl.
*F25B 41/00* (2021.01)
*F25B 47/02* (2006.01)

(52) U.S. Cl.
CPC ..... *F25B 47/02* (2013.01); *F25B 2700/2117* (2013.01)

(58) Field of Classification Search
CPC ..... F25B 7/02; F25B 2700/2117
(Continued)

(56) References Cited

U.S. PATENT DOCUMENTS 2,743,587 A 5/1956 Hubacker
4,262,496 A 4/1981 Bell, Jr.
(Continued)

FOREIGN PATENT DOCUMENTS

CN 101743449 A 6/2010
CN 108106283 A 6/2018
(Continued)

OTHER PUBLICATIONS

Bruce I. Nelson, "Optimizing Evaporator Runtime and Defrost Frequency," International Institute of Ammonia, Technical Papers Refrigeration, 37th Annual Meeting, Mar. 2015.
(Continued)

*Primary Examiner* — Davis D Hwu
(74) *Attorney, Agent, or Firm* — McCormick, Paulding & Huber PLLC

(57) ABSTRACT

A method for terminating defrosting of an evaporator (104) is disclosed. The evaporator (104) is part of a vapour compression system (100). The vapour compression system (100) further comprises a compressor unit (101), a heat rejecting heat exchanger (102), and an expansion device (103). The compressor unit (101), the heat rejecting heat exchanger (102), the expansion device (103) and the evaporator (104) are arranged in a refrigerant path, and an air flow is flowing across the evaporator (104). When ice is accumulated on the evaporator (104), the vapour compression system (100) operates in a defrosting mode. At least two temperature sensors (306, 307) monitor an evaporator inlet temperature, $T_{e,in}$, at a hot gas inlet (304) of the evaporator (104) and an evaporator outlet temperature, $T_{e,out}$, at a hot gas outlet (305) of the evaporator (104). A difference between $T_{e,in}$ and $T_{e,out}$, is monitored and defrosting is terminated when the rate of change of the difference between $T_{e,in}$ and $T_{e,out}$ approaches zero.

17 Claims, 7 Drawing Sheets

(58) Field of Classification Search
USPC ..... 62/208
See application file for complete search history.

(56) References Cited

U.S. PATENT DOCUMENTS

| | | | |
|---|---|---|---|
| 5,201,185 | A | 4/1993 | Hanson et al. |
| 5,261,246 | A | 11/1993 | Blackmon et al. |
| 7,685,830 | B2 | 3/2010 | Thybo et al. |
| 9,410,727 | B1 | 8/2016 | Boyko |
| 10,488,088 | B2 | 11/2019 | Verma et al. |
| 11,549,734 | B2 * | 1/2023 | Izadi-Zamanabadi ..... F25B 47/022 |
| 2009/0320504 | A1 | 12/2009 | Gupte |
| 2010/0199707 | A1 | 8/2010 | Pearson |
| 2012/0042667 | A1 | 2/2012 | Fulmer et al. |
| 2013/0086929 | A1 | 4/2013 | Senf, Jr. |
| 2015/0204589 | A1 | 7/2015 | Liu |
| 2015/0267930 | A1 | 9/2015 | Ryu et al. |
| 2021/0156600 | A1 | 5/2021 | Izadi-Zamanabadi et al. |

FOREIGN PATENT DOCUMENTS

| | | | |
|---|---|---|---|
| EP | 0115799 | A1 | 8/1984 |
| EP | 0256602 | A1 | 2/1988 |
| EP | 0345098 | A2 | 12/1989 |
| EP | 3315838 | A1 | 5/2018 |
| EP | 3591316 | A1 | 1/2020 |
| EP | 3660418 | A1 | 6/2020 |
| EP | 3660419 | A1 | 6/2020 |
| EP | 3660494 | A1 | 6/2020 |
| GB | 694763 | A | 7/1953 |
| JP | 2005226972 | A | 8/2005 |
| KR | 20160118748 | A * | 10/2016 |
| WO | 2010107536 | A2 | 9/2010 |
| WO | 2013082401 | A1 | 6/2013 |
| WO | 2016000750 | A1 | 1/2016 |
| WO | 2020169220 | A1 | 8/2020 |

OTHER PUBLICATIONS

Bruce I. Nelson, "Optimizing Hot Gas Defrost," Colmac Coil, Technical Bulletin, 2012.

D. A. Ali et al., "The Effects of Frost Formation on the Performance of Domestic Refrigerator-Freezer Finned-Tube Evaporator Coils," Department of Mechanical and Industrial Engineering University of illinois at Urbana-Champaign, Feb. 1992.

D. M. Admiraal et al., "Heat Transfer in Refrigerator Condensers and Evaporators," Air Conditioning and Refrigeration Center, University of Illinois, Mechanical & Industrial Engineering Dept., Aug. 1993.

Y. Kim et al., "Heat and Mass Transfer Coefficients Under Frost Conditions In A Finned-Tube Evaporator," International Refrigeration and Air Conditioning Conference, School of Mechanical Engineering, 2002.

Kyle A. Manske, "Performance Optimization of Industrial Refrigeration Systems," University of Wisconsin-Madison, 1999.

Nawaf Faisal Aljuwayhel, "Numerical and Experimental Study of the Influence of Frost Formation and Defrosting on the Performance of Industrial Evaporator Coils," University of Wisconsin-Madison, 2006.

Indian First Examination Report for Application No. 202017041515 dated Feb. 3, 2021.

International Search Report For Serial No. PCT/EP2019/065120 Dated Jul. 11, 2019.

Leijn Johannes Sjerp Lukasse, "Method for Reducing Ice Formation in a Cooling Unit", 2016, Full Document.

International Search Report For Serial No. PCT/EP2019/066443 Dated Jul. 30, 2019.

International Search Report For Serial No. PCT/EP2019/067750 Dated Aug. 8, 2019.

* cited by examiner (a)

(a)

(b)

(a)

(b)

(a)

(b)

METHOD FOR TERMINATING DEFROSTING OF AN EVAPORATOR

CROSS-REFERENCE TO RELATED APPLICATIONS

This application is a National Stage application of International Patent Application No. PCT/EP2019/065120, filed on Jun. 11, 2019, which claims priority to European Patent Application No. 18179424.9 filed on Jun. 22, 2018, each of which is hereby incorporated by reference in its entirety.

TECHNICAL FIELD

The present invention relates to a method for terminating defrosting of an evaporator by monitoring at least temperatures at an evaporator refrigerant inlet and evaporator refrigerant outlet. Defrosting is terminated when a rate of change of a difference between the two monitored temperatures approaches zero.

BACKGROUND

Vapour compression systems, such as refrigeration systems, heat pumps or air condition systems, are normally controlled in order to provide a required cooling or heating capacity in an as energy efficient manner as possible. In some scenarios, the operation of the vapour compression system may become energy inefficient, and the system may even become unstable or the system may become unable to provide the required cooling or heating capacity. In particular, during operation of a vapour compression system, such as a refrigeration system with a cooled chamber, ice or frost will deposit on the heat transfer surfaces of an evaporator. Namely, condensation of moisture in the cooled chamber leads to ice accumulation over time on the evaporator in the refrigeration system. Ice buildups disturb air circulation inside the system. This leads to a decrease in cooling efficiency and hence negatively impacts the heat transfer performance. Frost and ice buildups must be recognized before the cooling efficiency of the system has been significantly reduced. Once frost and ice has been identified, defrosting will be initiated and ice will start melting. During defrosting, the evaporator is heated in order to melt ice buildups. It is desired that this defrosting mode lasts as short as possible for a number of reasons. One of the reasons is again energy efficiency and energy consumption. Additionally, it is desired that items comprised in the cooled chamber are cooled almost all times. Therefore, in the most optimal case, defrosting should be terminated as soon as all the ice and frost has been melted.

In commercial refrigeration systems, termination of defrosting is typically performed after a predetermined period of time upon defrosting initiation. In one example, this predetermined period of time may not be sufficient for complete defrosting to happen and the system may have remaining ice on the evaporator. In another example, the predetermined period of time may be longer than what is needed for complete defrosting to happen and in such a case, the system is not under optimal conditions for a too long period of time as defrosting consumes excessive energy. In yet another example, the system may be programmed to terminate defrosting when a certain temperature inside the evaporator is achieved. This approach may as well not be the most optimal in terms of complete defrosting of the evaporator as some parts of it may still have remaining ice. Remaining ice influences operation of the system and degrades performances which should be at a high level right upon defrosting. Furthermore, the remaining ice may speed up accumulation of new ice layers.

US 2012/0042667 disclose an apparatus and method for terminating a refrigeration unit's defrost function. The refrigeration unit comprises an evaporator, a temperature sensor to measure the temperature of the evaporator during a defrost function, and a controller configured to calculate the rate of temperature change and terminate the defrost function when the rate meets a specified criteria, such as a predetermined rate or a sharp increase in the rate after the evaporator temperature has increased above the freezing point of water.

SUMMARY

It is an object of embodiments of the invention to provide a method for terminating full defrosting of an evaporator in an energy efficient manner, providing complete defrosting within an optimal period of time.

The invention provides a method for terminating defrosting of an evaporator, the evaporator being part of a vapour compression system, the vapour compression system further comprising a compressor unit, a heat rejecting heat exchanger, and an expansion device, the compressor unit, the heat rejecting heat exchanger, the expansion device and the evaporator being arranged in a refrigerant path, and an air flow flowing across the evaporator, the method comprising the steps of:

- operating the vapour compression system in a defrosting mode,
- monitoring, by at least two temperature sensors, an evaporator inlet temperature, $T_{e,in}$, at a hot gas inlet of the evaporator and an evaporator outlet temperature, $T_{e,out}$, at a hot gas outlet of the evaporator,
- monitoring a rate of change of a difference between $T_{e,in}$ and $T_{e,out}$, and
- terminating defrosting when the rate of change of the difference between $T_{e,in}$ and $T_{e,out}$ approaches zero.

The method for terminating defrosting of an evaporator is performed by measuring thermal capacity of ice and metal, i.e., a structural support of the evaporator. Ice buildups may delay heating up of the evaporator outlet. Therefore, by monitoring at least two temperatures at different places of the evaporator chances of having ice at one place on the evaporator while another is ice free are decreased. Further, a temperature of the evaporator may stabilize, i.e. become constant, only when ice is removed from its entire surface. Namely, the method relies on the temperature of the evaporator as a whole. When monitoring a rate of change of a difference between the at least two temperatures measured at different parts of the evaporator, defrosting can be terminated as soon as all the ice is removed from the surfaces of the evaporator.

The vapour compression system comprises an evaporator, a compressor unit, a heat rejecting heat exchanger and an expansion device. There may be more than one evaporator and more than one expansion device. The compressor unit may comprise one or more compressors. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The evaporator is arranged in the refrigerant path. Evaporation of a liquid part of the refrigerant takes place in the evaporator, while heat exchange takes place between the refrigerant and the ambient or a secondary fluid flow across the evaporator, in such a manner that heat is absorbed by the refrigerant passing through the evaporator.

The compressor unit receives the refrigerant from the evaporator. The refrigerant is then normally in gaseous phase and the compressor unit compresses it and supplies it further to the heat rejecting heat exchanger.

The heat rejecting heat exchanger may, e.g., be in the form of a condenser, in which refrigerant is at least partly condensed, or in the form of a gas cooler, in which refrigerant is cooled, but remains in a gaseous or trans-critical state. The heat rejecting heat exchanger is also arranged in the refrigerant path.

The expansion device may, e.g., be in the form of an expansion valve. The expansion device is arranged in the refrigerant path, supplying refrigerant to the one or more evaporator. In a vapour compression system, such as a refrigeration system, an air condition system, a heat pump, etc., a fluid medium, such as refrigerant, is thereby alternatingly compressed by means of one or more compressors and expanded by means of one or more expansion devices, and heat exchange between the fluid medium and the ambient takes place in one or more heat rejecting heat exchangers, e.g. in the form of condensers or gas coolers, and in one or more heat absorbing heat exchangers, e.g. in the form of evaporators.

According to the invention, the vapour compression system is operating in a defrosting mode. The defrosting mode is initiated to remove any frost or ice buildup on the evaporator. The defrosting mode may be initiated when necessary, i.e., when frost of ice buildup reaches a predetermined level or alternatively according to a predefined schedule. When operating in the defrosting mode, the evaporator is heated, and therefore any frost or ice formed on the evaporator is melted. Heating of the evaporator may be performed by injecting a hot gas into the evaporator through an evaporator inlet. Alternatively, the evaporator may be heated in another manner, such as by means of an electrical heater.

During defrosting, at least two temperature sensors monitor temperatures at the evaporator inlet, $T_{e,in}$, where the hot gas enters the evaporator and at an evaporator outlet, $T_{e,out}$, where the hot gas leaves the evaporator. The at least two temperatures may be monitored from the beginning of the defrosting mode. Alternatively, monitoring the temperatures may start after a certain period of time upon the initiation of the defrosting mode, as in the initial phase of defrosting no ice will be melted, but energy may rather be spent on heating the evaporator itself. Preferably, the temperatures may be monitored only after several minutes, once the evaporator and its tubes are heated. When starting the defrosting cycle there will be a large step when a difference in temperatures changes over time. Analysis of this step may not be needed. Therefore, a delay in logging the temperatures may be useful in order to perform signal processing faster. The temperatures may be continuously monitored over time during defrosting. Alternatively, the temperatures may be measured intermittently, with a certain frequency. The temperature sensors may be placed on the structural support of the evaporator and/or on one or more of its tubes. In this way, the temperature of the surface near the hot gas inlet of the evaporator is measured as well as the surface near the hot gas outlet of the evaporator. The measured temperatures may be communicated to a control unit or a processor.

A difference between $T_{e,in}$ and $T_{e,out}$ and a rate of change of a difference between $T_{e,in}$ and $T_{e,out}$ are monitored, e.g. by means of the control unit or processor mentioned above. Typically, at the beginning of defrosting, the temperatures at the inlet and at the outlet of the hot gas, respectively, will be substantially identical. Then, the temperature at the evaporator hot gas inlet may begin to rise faster than the temperature at the evaporator hot gas outlet. This is expected, as the hot gas may heat the structural support of the evaporator and melt frost and ice at the areas closer to the hot gas inlet first. Depending on the amount of frost or ice, a time period during which the temperatures at the inlet and outlet of the evaporator are different and rise in different manner may vary.

As frost and ice is melting from the evaporator, temperatures at the inlet and outlet of the evaporator may stabilize and reach constant values. When both temperatures have the constant values, their difference will become constant and therefore the rate of change of the difference will be zero. When the rate of change of the difference between $T_{e,in}$ and $T_{e,out}$ approaches zero the evaporator operates in a manner which is expected when there is no ice or frost on its surface. Therefore, no change in the difference between the two temperatures indicates that all the ice or frost has been removed and there is no need for further defrosting. The processor may analyse the rate of change of the difference over time. If the rate of change of the difference is zero for a certain period of time, information from the processor may be communicated to another control unit in order to stop defrosting. In this manner, defrosting is terminated as soon as all frost or ice is removed from all the surfaces of the evaporator.

In one embodiment of the invention, the step of terminating defrosting may be performed when the rate of change of the difference between $T_{e,in}$ and $T_{e,out}$ has been smaller than a predetermined threshold value for a predetermined time. During defrosting and for a short period of time, it may happen that both temperatures of the inlet and outlet of the evaporator change in the same manner. The rate of change between $T_{e,in}$ and $T_{e,out}$ during this short period of time may be close to zero. This situation may arise, e.g., when the evaporator reaches the freezing point of water, and due to the ice buildups, temperatures $T_{e,in}$ and $T_{e,out}$ may both be close to the freezing point of water and keep the same value for a short period of time. To avoid a premature termination of defrosting, the rate of change may be smaller than the predetermined threshold value for a predetermined period of time. The predetermined time may be longer than one minute. The predetermined threshold value may be such as between 0° C./s and 5° C./s, such as between 0° C./s and 4° C./s, such as between 0° C./s and 3° C./s, such as between 0° C./s and 2° C./s, and such as between 0° C./s and 1° C./s around zero, and such as 1° C./s, such as 2° C./s, such as 3° C./s, such as 4° C./s, and such as 5° C./s. Alternatively, the predetermined threshold value may be determined during the measurements as the dynamic behaviour of the air temperature may depend on the size, shape and operating conditions of the operator.

During the defrosting mode the hot gas from the compressor unit may be supplied to the hot gas inlet of the evaporator and through refrigerant passages of the evaporator. According to this embodiment, the evaporator may be heated by means of the hot gas from the compressor unit. The hot gas from the compressor may be led backwards through the system to the evaporator, e.g. by appropriately switching one or more valves. The cooling process thereby stops, and the system is operated in a 'reversed mode', in the sense that the refrigerant flow in the system is reversed. A temperature of the hot gas may vary depending on ambient conditions and conditions of the vapour compression system. Typically, the hot gas temperature is significantly higher that the melting temperature of ice. The hot gas temperature may be at least 10° C., such as at least 20° C., and such as at least 30° C. Additionally, the hot gas temperature may not be higher than 50° C. If the hot gas is too hot then a humid cloud may form from melted ice. This humid cloud may then stay near the evaporator what is undesired, as melted ice is preferably kept in liquid phase when melted. Water formed from melted ice may flow and run out of the evaporator through a drain pipe. If the humid cloud is formed and it stays around the evaporator, once defrosting is finished, moisture from the humid cloud may deposit on the evaporator again and deteriorate performance of the evaporator in the same manner as ice.

As an alternative, the evaporator may be heated in any other suitable manner, such as by means of an electric heating element or the like.

The hot gas may gradually heat the evaporator from the top to the bottom, i.e., the hot gas may enter in the top tubes of the evaporator and flow gradually to the bottom of the evaporator while heating the evaporator and melting ice buildups. The hot gas may enter the evaporator in its top as an inlet feed pipe is typically arranged at the top of the evaporator for safety reasons, or to remove a risk of liquid hammering. The hot gas inlet may be an outlet when the system is a cooling mode. Alternatively, the hot gas may gradually heat the evaporator from the bottom to the top, i.e., the hot gas may enter from the bottom tubes of the evaporator and flow gradually towards the top of the evaporator while heating the evaporator and melting ice buildups.

Air in the evaporator and the air surrounding the evaporator may be heated by means of convection. Convection may happen naturally due to differences in temperature of the tubes and the air surrounding them and the air surrounding the evaporator. Convection may be initiated as soon as the surface of the evaporator itself and the tubes of the evaporator are heated. The air may flow into the direction where a fan of the evaporator is and towards an opening on the inlet side of the evaporator. During defrosting, the fan of the evaporator may be turned off, and therefore it may not interfere with the defrosting process and a heat circulation.

In one embodiment of the invention, the evaporator may be in a flooded state. According to this embodiment, the system may also comprise one or more receivers and pumps for liquid part of the refrigerant. Liquid refrigerant is present throughout the entire length of the evaporator, and liquid refrigerant may be allowed to leave the evaporator. In order to prevent liquid refrigerant from reaching the compressor unit, a receiver may be arranged in the refrigerant path between the evaporator and the compressor unit. The receiver may then separate the refrigerant into a gaseous part and a liquid part, and the gaseous part may be supplied to the compressor unit. However, when liquid refrigerant is present throughout the entire length of the evaporator it is ensured that the potential cooling capacity of the evaporator is utilised to a maximum extent. Therefore, the most of the heat generated by the evaporator may be used for evaporation. In industrial applications, such as big cooling houses, flooded evaporators may, thus, be used in order to maximize the cooling capacity.

Alternatively, the evaporator may be in a non-flooded state, i.e. only superheated gaseous refrigerant is allowed to leave the evaporator.

The method for terminating defrosting by means of a hot gas as presented above may be used in any type of evaporator.

In one embodiment of the invention, the method may further comprise the steps of:

monitoring, by at least one additional temperature sensor, at least one temperature, $T_{air}$, of air leaving the evaporator, monitoring a rate of change of the temperature, $T_{air}$, and terminating defrosting when the rate of change of the temperature, $T_{air}$, approaches zero.

BRIEF DESCRIPTION OF THE DRAWINGS

The invention will now be described in further detail with reference to the accompanying drawings in which.

DETAILED DESCRIPTION

Figure 1:
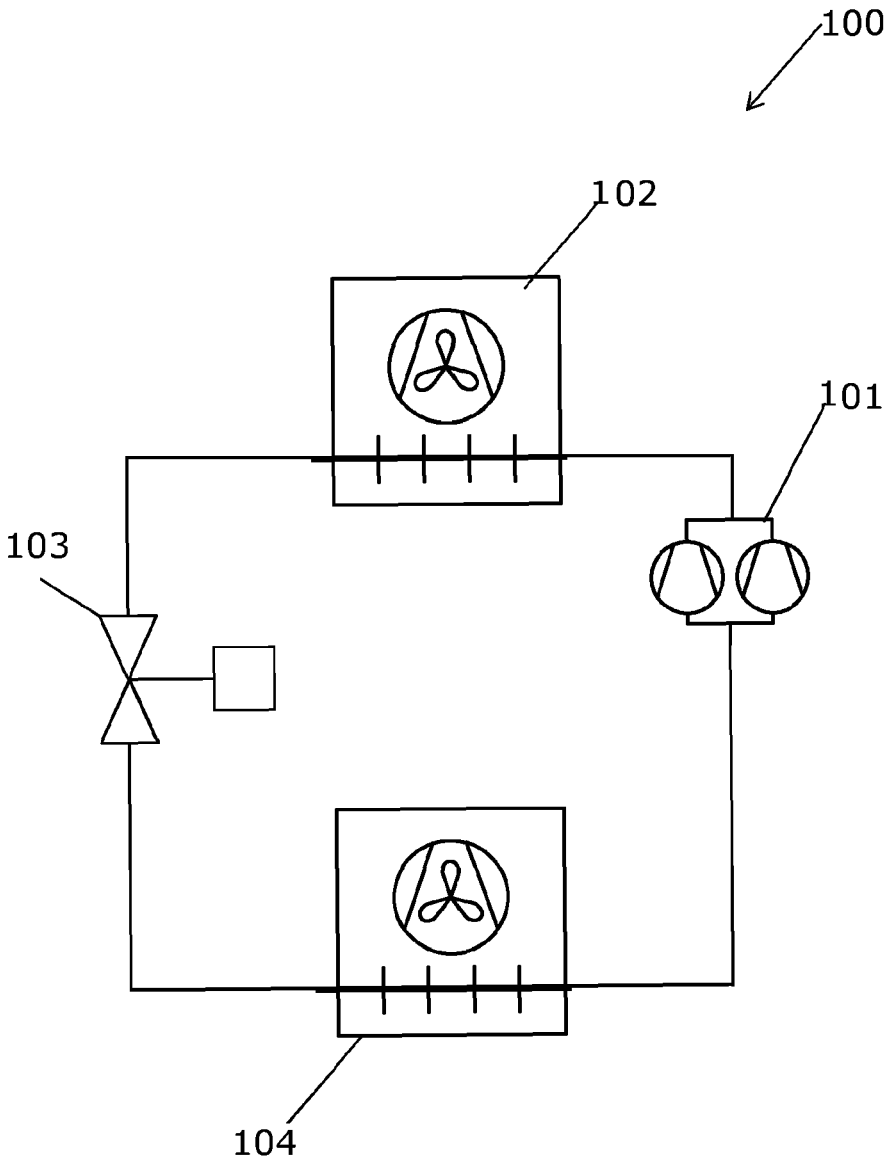
FIG. 1 shows a simplified diagram of a vapour compression system.

FIG. 1 shows a simplified diagram of a vapour compression system 100 comprising a compressor unit 101, a heat rejecting heat exchanger 102, an expansion device 103 and an evaporator 104. The compressor unit 101 shown in FIG. 1 comprises two compressors. It is noted that it is within the scope of the present invention that the compressor unit 101 comprises only one compressor, e.g. a variable capacity compressor, or that the compressor unit 101 comprises three or more compressors. Refrigerant flowing through the system 100 is compressed by the compressor unit 101 before being supplied to the heat rejecting heat exchanger 102. In the heat rejecting heat exchanger 102, heat exchange takes place with a secondary fluid flow across the heat rejecting heat exchanger 102 in such a manner that heat is rejected from the refrigerant. In the case that the heat rejecting heat exchanger 102 is in the form of a condenser, the refrigerant passing through the heat rejecting heat exchanger 102 is at least partly condensed. In the case that the heat rejecting heat exchanger 102 is in the form of a gas cooler, the refrigerant passing through the heat rejecting heat exchanger 102 is cooled, but it remains in a gaseous state.

The refrigerant leaving the heat rejecting heat exchanger 102 is then passed through the expansion device 103 which may, e.g., be in the form of an expansion valve. The refrigerant passing through the expansion device 103 undergoes expansion and is further supplied to the evaporator 104. In the evaporator 104, heat exchange takes place with a secondary fluid flow across the evaporator 104 in such a manner that heat is absorbed by the refrigerant, while the refrigerant is at least partly evaporated. The refrigerant leaving the evaporator 104 is then supplied to the compressor unit 101.

Figure 2:
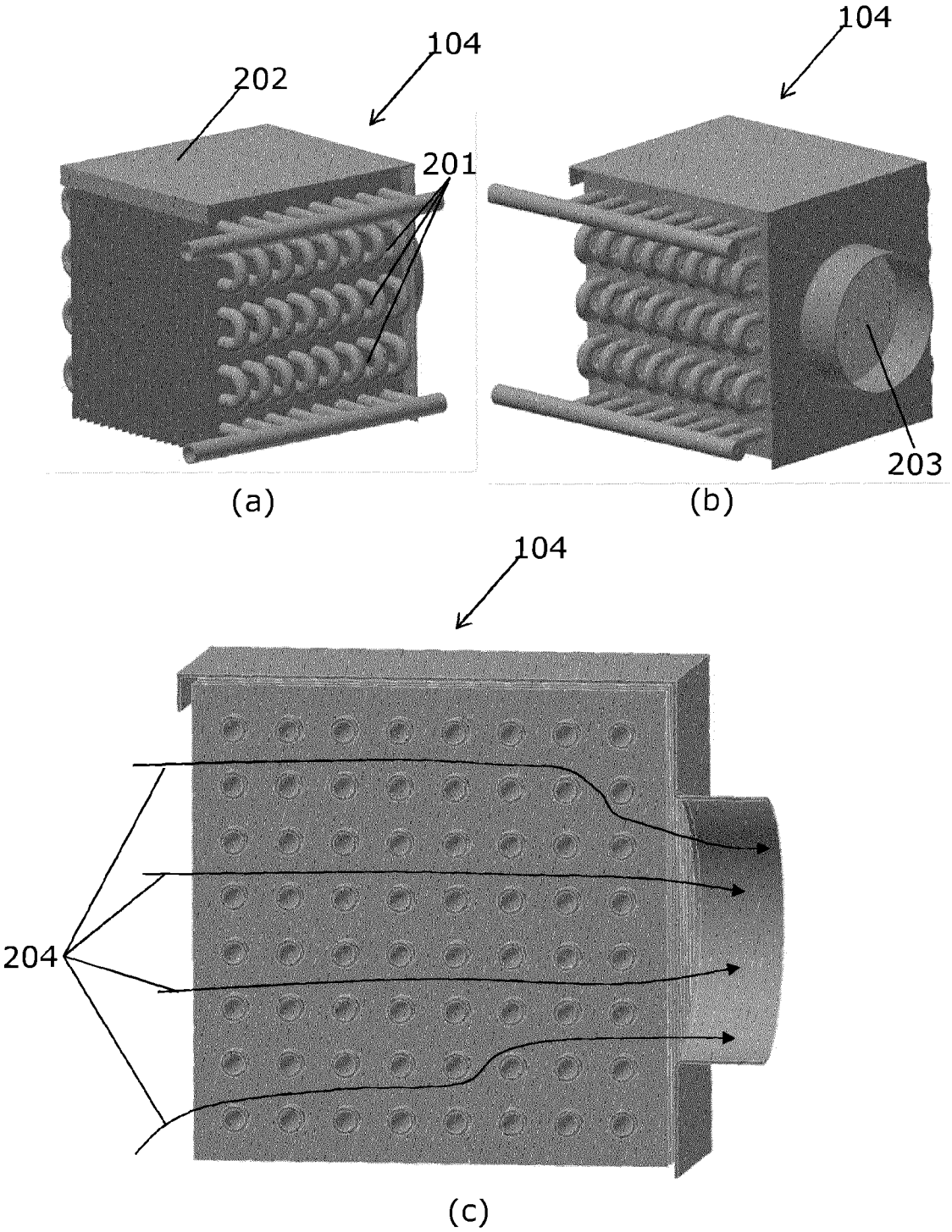
FIG. 2 shows a perspective view of an evaporator (a), (b) and an air flow through the evaporator in a cooling mode (c)

FIGS. 2(*a*) and 2(*b*) show perspective views of a generic model of an evaporator 104. In the evaporator 104 the liquid refrigerant is evaporated into a gaseous form/vapour. The evaporator 104 of FIG. 2 comprises a plurality of tubes 201 which guide the liquid refrigerant there through and which are enclosed in an evaporator structural support 202. The tubes 201 may typically be arranged in a horizontal manner. The length of the tubes 201 may vary and that length may define one dimension of the evaporator 104. The evaporator 104 comprises a fan 203 which drives a secondary air flow across the evaporator 104 and over the evaporator tubes 201 as indicated by arrows 204 in FIG. 2(*c*). In case of a refrigeration system, the liquid refrigerant absorbs heat from the air passing through the evaporator 104, thereby reducing the temperature of the air and providing cooling for a closed volume being in contact with the evaporator 104. The closed volume may, e.g., be a refrigeration chamber.

Figure 3:
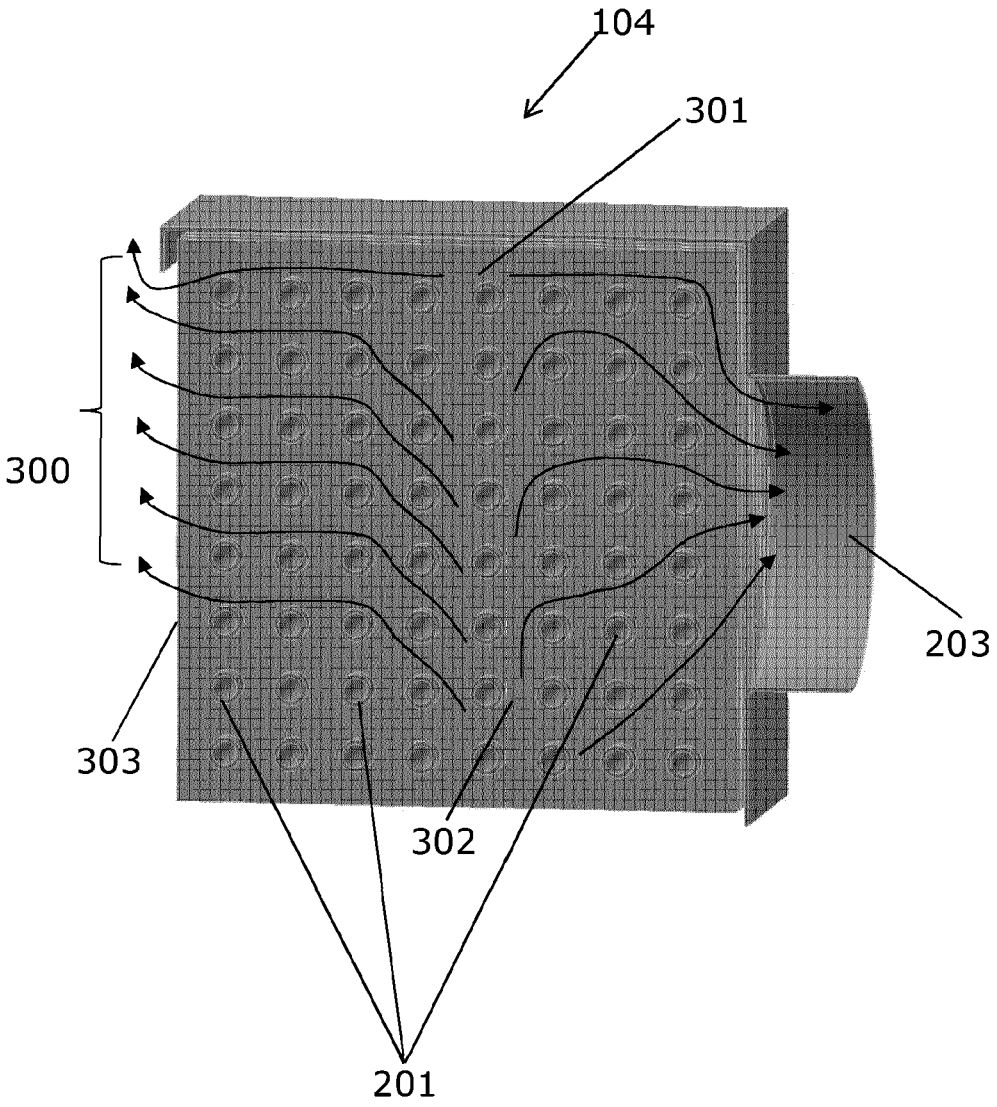
FIG. 3 shows natural air flow in an evaporator operating in a defrosting mode.
Figure 3:
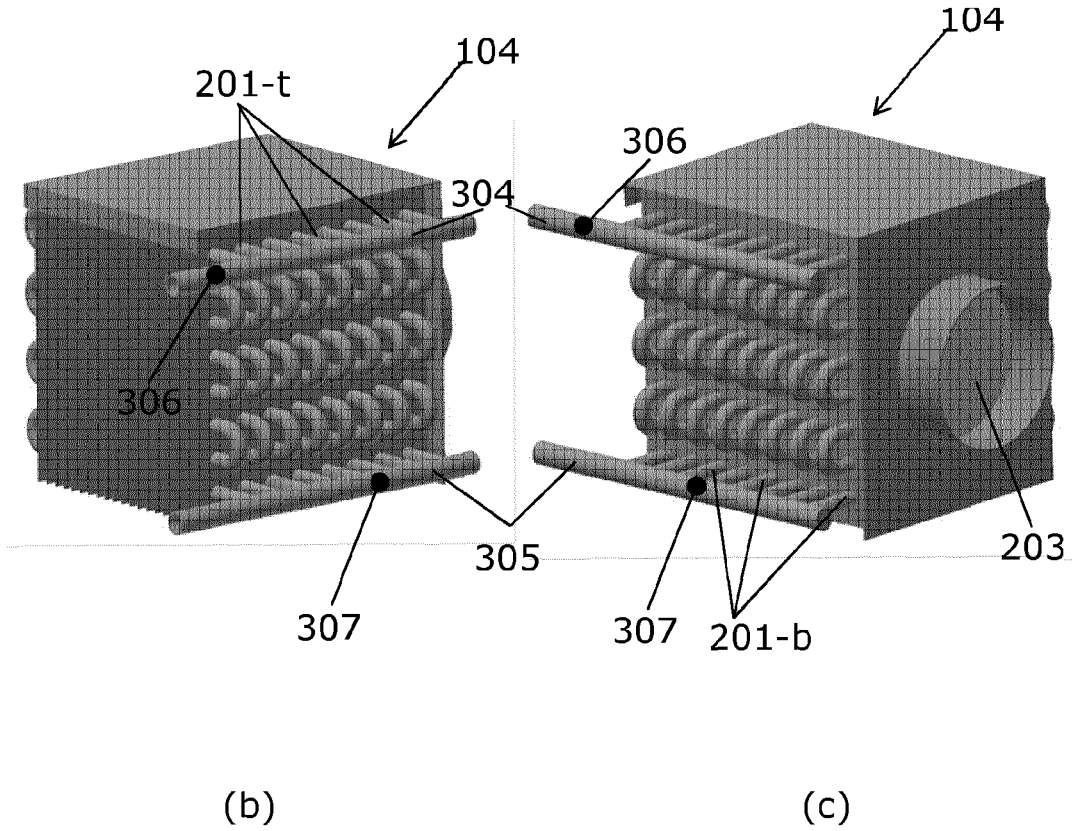

FIG. 3(*a*) shows a cross-section of the evaporator 104 operating in a defrosting mode. During the defrosting mode, the fan 203 is turned off. In the defrosting mode, the tubes 201 may be heated from inside by a hot gas. When defrosting with the hot gas, the evaporator 104 is heated from the top part 301 and as the hot gas flows through the tubes 201 all of metal of the evaporator 104 is gradually heated. The hot gas will gradually flow towards the bottom part 302 of the evaporator 104. Because of the mass and gradual cooling/condensing of the hot gas, the top 301 and bottom 302 of the evaporator are heated with a delay. The hot gas heats up the tubes 201, heats and melts ice accumulated on the tubes 201 and fins (not shown). While the entire evaporator 104 is heating, convection to the surrounding air is happening, i.e., the volume of air between the fins and tubes 201 is also heating. The volume of air will start natural movement, as indicated by arrows 300, due to differences in temperature. The volume of air moves into the direction of the fan 203 and towards openings on the inlet side 303 of the evaporator 104.

FIGS. 3(*b*) and 3(*c*) show perspective view of two opposite sides of the evaporator 104 with horizontally connected tubes 201 such that there is a continuous flow path from the top to the bottom of the evaporator 104. A central feed pipe 304 at the top of the evaporator 104 is configured to feed each of the top tubes 201-*t*. Refrigerant flows through the entire evaporator 104 until it exits at the bottom of the evaporator 104 through a central suction pipe 305. The hot gas may also enter the central feed pipe 304, at the top of the evaporator 104, heat it, and then leaves the tubes at the central suction pipe 305. The central suction pipe 305 at the bottom of the evaporator 104 is fed by the bottom tubes 201-*b*.

During defrosting, at least two temperature sensors 306 and 307 monitor temperatures at the hot gas inlet 304, $T_{e,in}$, where the hot gas enters the evaporator 104 and at the hot gas outlet 305, $T_{e,out}$, where the hot gas leaves the evaporator 104. The temperature sensors 306 and 307 may be placed on the outer side of the central feed pipe 304 and the central suction pipe 305, respectively. Alternatively, the temperature sensor 306 may be placed on one of the top tubes 201-*t*, and the temperature sensor 307 may be placed on one of the bottom tubes 201-*b*. in yet one alternative, the sensors 306 and 307 may be placed on the bends of the tubes at the end of the evaporator (not shown). In this way, the temperature of the surface near the hot gas inlet 304 of the evaporator 104 is measured as well as the surface near the hot gas outlet 305 of the evaporator 104.

Figure 4:
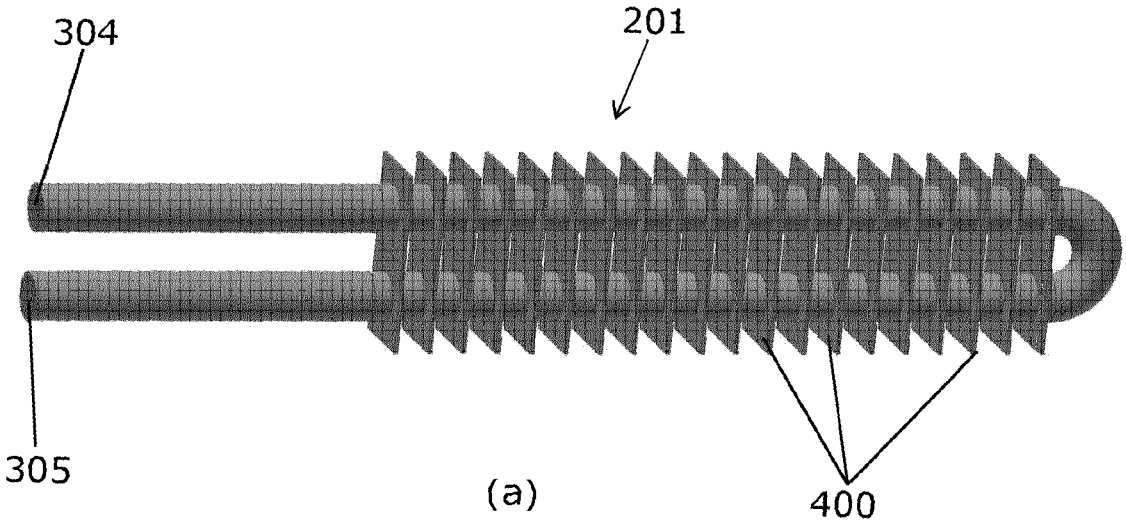
FIG. 4 shows an evaporator tube without (a) and with (b) ice buildup.
Figure 4:
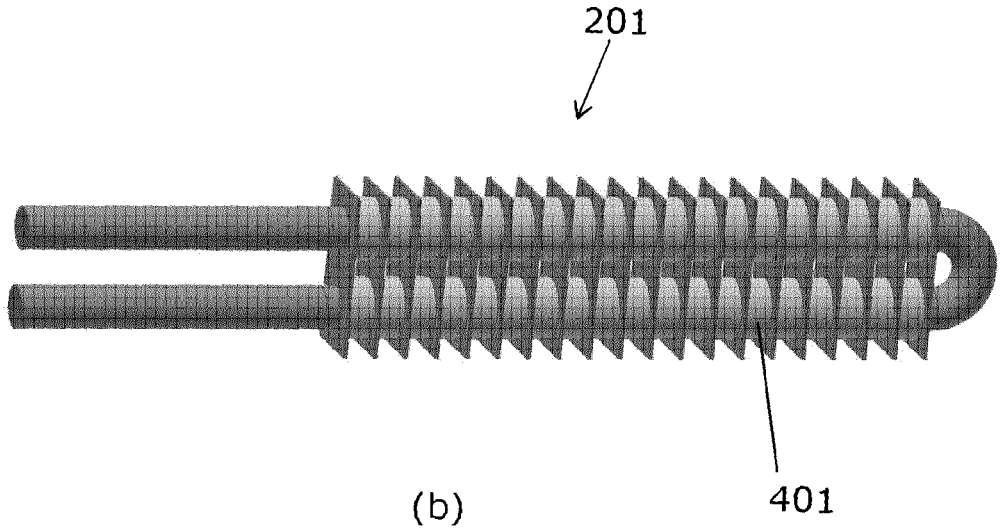

FIG. 4(*a*) shows a simplified evaporator tube 201 without any buildup of ice. FIG. 4(*a*) shows the fins 400 of the evaporator tube 201. FIG. 4(*b*) shows the evaporator tube 201 with ice buildup 401. The tube 201 has an inlet to which the central feed pipe 304 is merged and an outlet to which the central suction pipe 305 is merged, where the hot gas may enter and exit the evaporator. In the defrosting mode, the hot gas is introduced into the central feed pipe 304 of the tube 201. Normally, the inlet of the tube 201 will have higher temperature than the outlet of the tube.

Figure 5:
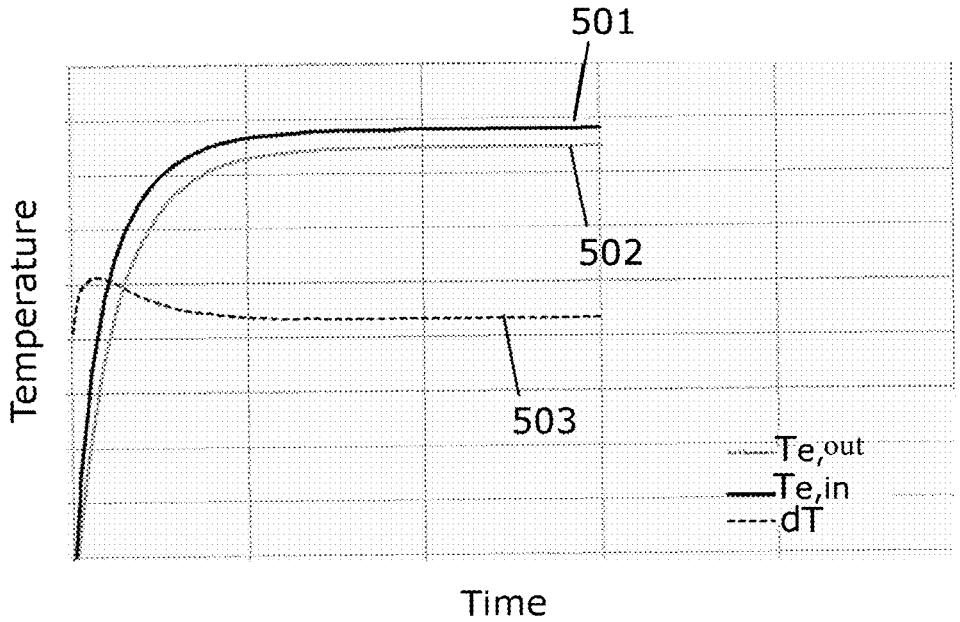
FIG. 5 shows diagrams of surface temperature changes over time of an evaporator tube when there is no ice buildup on the tube.
Figure 5:
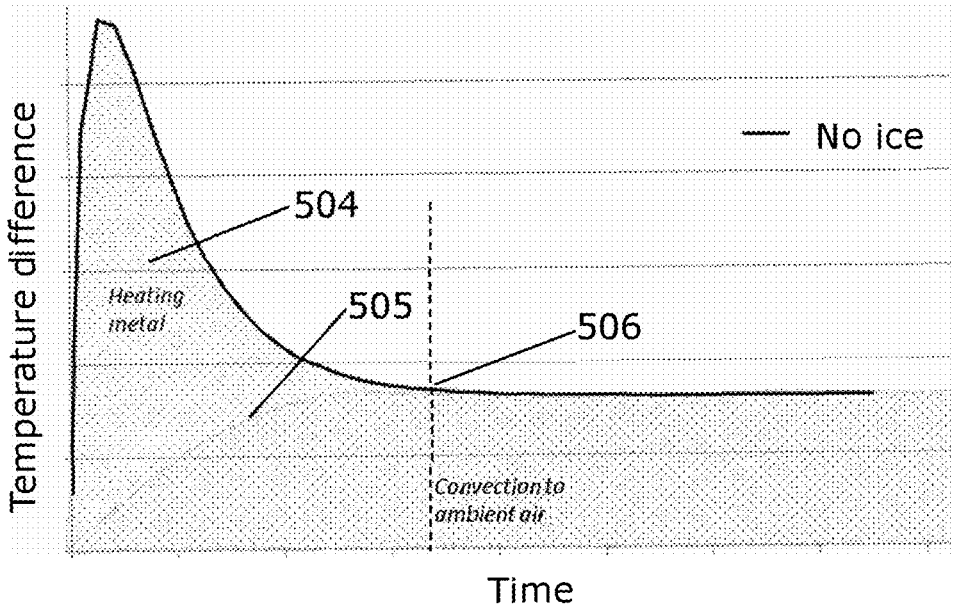

FIG. 5 shows diagrams of surface temperature changes over time of an evaporator tube when there is no ice buildup on the tube. Curves 501 and 502 represent temperature of a tube inlet and outlet over time respectively and curve 503 is the difference between the inlet and outlet temperatures. Even when there is no ice on the evaporator, some time is needed to reach stable condition, i.e., to reach a point when there a rate of change if a difference between the two temperatures approaches zero. As shown in FIG. 5(*b*), in the zone 504, heating of the evaporator itself happens and that requires certain amount of energy. As soon as the evaporator starts to be heated, convection of the hot air to ambient starts, as indicated by curve 505. Convection of the hot air dominates when the evaporator stable conditions are reached, and this is indicated by dashed line 506.

Figure 6:
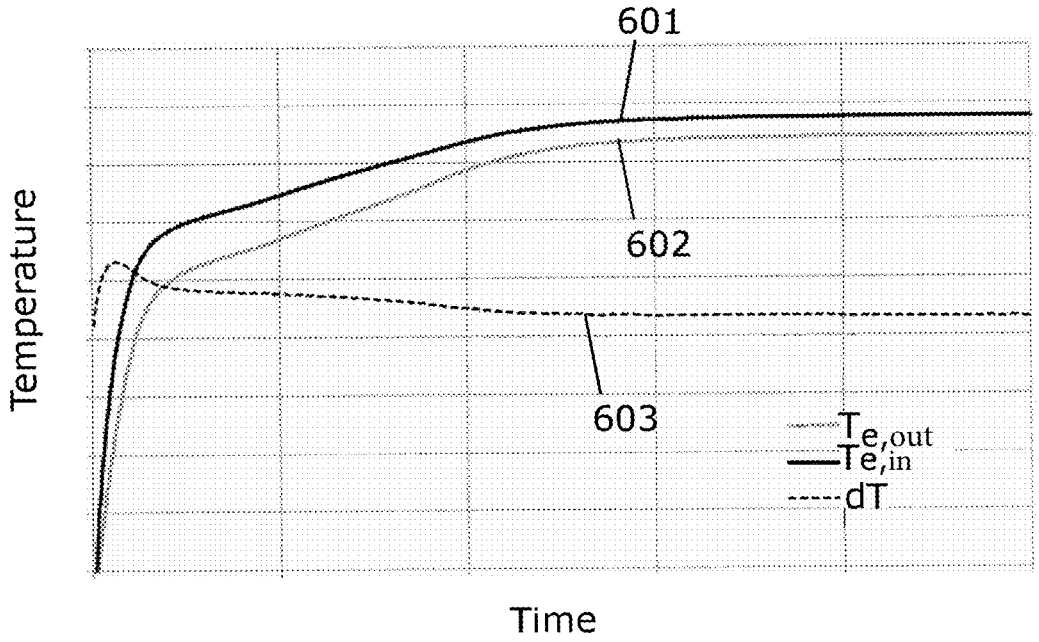
FIG. 6 shows diagrams of surface temperature changes over time of an evaporator tube when there is ice buildup on the tube.
Figure 6:
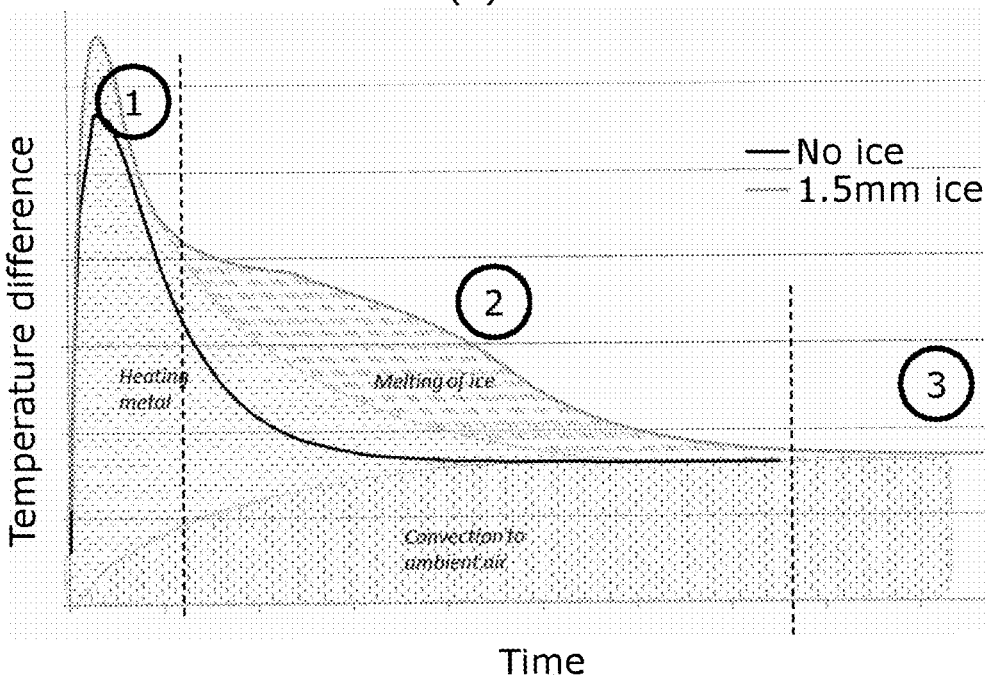

FIG. 6(*a*) shows diagrams of surface temperature changes over time of an evaporator tube when there is ice buildup on the tube. Curve 601 represents temperature of a tube inlet over time, $T_{e,in}$, and curve 602 represents a temperature of a tube outlet over time, $T_{e,out}$. The difference between $T_{e,in}$ and $T_{e,out}$ is represented by curve 603. A derivative over time of the difference between $T_{e,in}$ and $T_{e,out}$, i.e., a derivative of curve 603 represents a rate of change of the difference between $T_{e,in}$ and $T_{e,out}$. Typically, at the beginning of defrosting, both temperature at the inlet and outlet will be the same, as can be seen from the curves 601 and 602. Then, the temperature at the evaporator inlet may begin to rise faster than the temperature at the evaporator outlet. This is expected, as the hot gas will heat the structural support of the evaporator and melt frost and ice at the areas closer to the hot gas inlet. Depending on the amount of frost or ice, a time period during which the temperatures at the inlet and outlet of the evaporator are different and rise in different manner may vary.

As frost and ice melt from the evaporator, temperatures of the inlet and outlet of the evaporator may stabilize and reach constant values, as shown by the last portion of the curves 601 and 602. When both temperatures have the constant values, their difference becomes constant and therefore the rate of change of the difference approaches zero, as represented by the last portion of the curve 603. When the rate of change of the difference between $T_{e,in}$ and $T_{e,out}$ approaches zero the evaporator operates as when there is no ice or frost on its surface, i.e. as illustrated in FIG. 5. Therefore, no change in the difference between the two temperatures indicates that all the ice or frost has been removed and there is no need for further defrosting. At this point, defrosting may be terminated as all frost or ice has been removed from the evaporator. Time required for full defrosting to happen, may depend on various factors such as size of the vapour compression system, temperature of the hot gas, amount of ice to be melted, temperature of the system at the beginning of defrosting, ambient conditions such as temperature, pressure, humidity, and the like.

FIG. 6(*b*) shows a comparison between an evaporator without ice and an evaporator with 1.5 mm ice buildup. It can be seen from the FIG. 6(*b*) that ice influences transient behaviour of the evaporator. It can be seen from the graphs that in a zone 1, the heating of the evaporator is mainly happening. In a zone 2, most of the ice is melted and extra heat capacity is required to elevate temperature of the evaporator tubes and melt ice. The area below the curves represents the energy needed to heat up the evaporator and melt ice buildups. The stable condition is reached in a zone 3, when the evaporator is ice-free and normal thermal convection happens. Naturally, this occurs later than in case when there is no ice buildup on the evaporator.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for terminating defrosting of an evaporator, the evaporator being part of a vapour compression system, the vapour compression system further comprising a compressor unit, a heat rejecting heat exchanger, and an expansion device, the compressor unit, the heat rejecting heat exchanger, the expansion device and the evaporator being arranged in a refrigerant path, and an air flow flowing across the evaporator, the method comprising the steps of:

operating the vapour compression system in a defrosting mode, during defrosting, monitoring, by at least two temperature sensors, an evaporator inlet temperature, $T_{e,in}$, at a hot gas inlet of the evaporator and an evaporator outlet temperature, $T_{e,out}$, at a hot gas outlet of the evaporator, monitoring a rate of change of a difference between $T_{e,in}$ and $T_{e,out}$, and terminating defrosting when the rate of change of the difference between $T_{e,in}$ and $T_{e,out}$ approaches zero.

2. The method according to claim 1, wherein the step of terminating defrosting is performed when the rate of change of the difference between $T_{e,in}$ and $T_{e,out}$ has been smaller than a predetermined threshold value for a predetermined time.

3. The method according to claim 1, wherein during the defrosting mode a hot gas from the compressor unit is supplied to the hot gas inlet of the evaporator and through refrigerant passages of the evaporator.

4. The method according to claim 3, wherein the hot gas gradually heats the evaporator from the top to the bottom.

5. The method according to claim 3, wherein air in the evaporator and the air surrounding the evaporator are heated by means of convection.

6. The method according to claim 1, wherein the evaporator is in a flooded state.

7. The method according to claim 1, wherein the evaporator is in a non-flooded state.

8. The method according to claim 2, wherein during the defrosting mode a hot gas from the compressor unit is supplied to the hot gas inlet of the evaporator and through refrigerant passages of the evaporator.

9. The method according to claim 4, wherein air in the evaporator and the air surrounding the evaporator are heated by means of convection.

10. The method according to claim 2, wherein the evaporator is in a flooded state.

11. The method according to claim 3, wherein the evaporator is in a flooded state.

12. The method according to claim 4, wherein the evaporator is in a flooded state.

13. The method according to claim 5, wherein the evaporator is in a flooded state.

14. The method according to claim 2, wherein the evaporator is in a non-flooded state.

15. The method according to claim 3, wherein the evaporator is in a non-flooded state.

16. The method according to claim 4, wherein the evaporator is in a non-flooded state.

17. The method according to claim 5, wherein the evaporator is in a non-flooded state.

* * * * *